United States Patent [19]

Boyadjieff et al.

[11] Patent Number: 4,595,062

[45] **Date of Patent: * Jun. 17, 1986**

[54] WELL CASING JACK MECHANISM

[75] Inventors: George I. Boyadjieff, Anaheim; Andrew B. Campbell, San Marino, both of Calif.

[73] Assignee: Varco International, Inc., Orange, Calif.

[ * ] Notice: The portion of the term of this patent subsequent to Oct. 16, 2001 has been disclaimed.

[21] Appl. No.: 169,718

[22] Filed: Jul. 17, 1980

[51] Int. Cl.[4] ..... E21B 7/20

[52] U.S. Cl. ..... 166/379; 166/380; 166/77; 166/85; 175/171; 254/29 R

[58] Field of Search ..... 175/22, 57, 171, 195, 175/202, 203; 166/71, 315, 85, 77, 379-381; 405/228, 197, 199; 254/29 R

[56] References Cited

U.S. PATENT DOCUMENTS

| | | | |
|---|---|---|---|
| Re. 25,680 | 11/1964 | Brown | 254/29 R |
| 1,894,039 | 1/1933 | Hill | 175/171 |
| 2,126,933 | 8/1938 | Stone et al. | 254/29 R |
| 2,292,126 | 8/1942 | Isley | 175/25 |
| 2,641,444 | 6/1953 | Moor | 175/171 |
| 2,661,063 | 12/1953 | Owens | 166/85 |
| 3,180,617 | 4/1965 | Brown | 166/315 |
| 3,257,099 | 6/1966 | Merritt | 254/103 |
| 3,316,963 | 5/1967 | Boldrick et al. | 166/315 |
| 3,722,603 | 3/1973 | Brown | 173/159 |
| 4,125,164 | 11/1978 | Terry | 166/85 |
| 4,162,704 | 7/1979 | Guntler | 166/77 |

FOREIGN PATENT DOCUMENTS

| | | |
|---|---|---|
| 47-26840 | 1/1972 | Japan . |
| 1229327 | 4/1971 | United Kingdom . |

*Primary Examiner*—James A. Leppink
*Assistant Examiner*—William P. Neuder
*Attorney, Agent, or Firm*—William P. Green

[57] ABSTRACT

A casing jacking mechanism is positionable in the rotary table opening of a well drilling rig to lower casing into the well, and is preferably formed sectionally of a number of components adapted to be assembled temporarily on the rig and subsequently dismantled after the casing has been lowered. The jacking machanism may include a first support structure to be located above the upper end of the well, two piston and cylinder mechanisms adapted to be lowered at different sides of the axis of the well to positions in which their cylinders are connected by the support structure, a second support structure connectable to and actuable vertically by the pistons of the piston and cylinder mechanisms a spider unit adapted to be placed on the first support structure and releasably engageable with the well pipe, and an elevator to be positioned on the second support structure for movement vertically therewith and also releasably engageable with the well pipe.

11 Claims, 18 Drawing Figures

WELL CASING JACK MECHANISM

BACKGROUND OF THE INVENTION

This invention relates to improved jacking mechanisms for lowering a well pipe such as a casing into a well bore.

In wells of substantial depth, the weight of the casing which is required to line the well can become very great, and may exceed the load capacity of a rig mast and other related equipment which are otherwise satisfactory to meet all requirements of drilling the well and placing it in production. For example, a mast and other equipment having a 500 ton capacity may be entirely adequate for handling the drill pipe and other equipment employed in drilling a well, but may be of insufficient capacity to suspend and progressively lower the relatively large diameter casing which must ultimately be positioned in the well. To employ a mast and other equipment of heavier capacity, for example with a 1,000 ton load limit, during the entire drilling operation, is economically inefficient, but may be necessary unless other means are provided for lowering the casing.

SUMMARY OF THE INVENTION

The present invention provides improved methods and apparatus for effectively handling the weight of a lengthy and heavy string of casing without transmitting the load of the casing to the drilling mast, and in a manner adapting the rig to handle greater loads during the casing lowering operation than during other stages of drilling and completing a well.

These results are attained by positioning a special jacking mechanism on the rig at a location above the well bore to progressively jack the casing downwardly into the well without support of any of the weight of the casing by the mast. The rotary table of the drill rig is preferably removed from its opening in the rig floor, and the jacking mechanism of the invention is positioned in that opening, desirably with piston and cylinder means of the jacking mechanism projecting downwardly beneath the floor and beyond the rotary table supporting beam structure, and with two releasable slip-type pipe supporting units at the upper end of the jacking mechanism being engageable with the pipe at spaced locations and relatively vertically actuable to advance the casing downwardly. There are preferably at least two piston and cylinder mechanisms received at different sides of the well bore axis, with a first support structure extending between and connecting first sections of these mechanisms and a second support structure extending between and connecting second sections of the mechanisms, desirably by attachment to upper ends of the piston rods of the mechanisms. The first support structure may be mounted on a pair of columns which project downwardly to engage and be supported by a foundation or base, and which may contain the piston and cylinder mechanisms.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
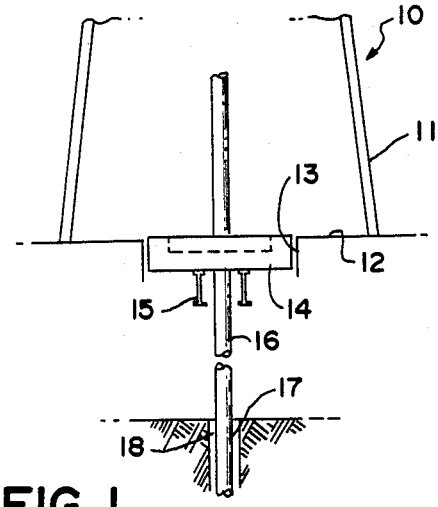
FIG. 1 is a diagrammatic representation of a well rig during a drilling operation, with the rotary table in position in the rig.

The conventional well drilling rig which is represented diagrammatically at 10 in FIG. 1 includes the usual mast 11 projecting upwardly above the rig floor 12 which contains an opening 13 within which the rotary table 14 is mounted. A pair of parallel horizontal "I" beams 15 extend across the underside of opening 13, and are secured at opposite ends to the rig floor and substructure, and provide a base on which the rotary table is supported. A kelly 16 is driven rotatably by the rotary table and in turn drives the drill string 17 to drill a well bore 18.

Figure 2:
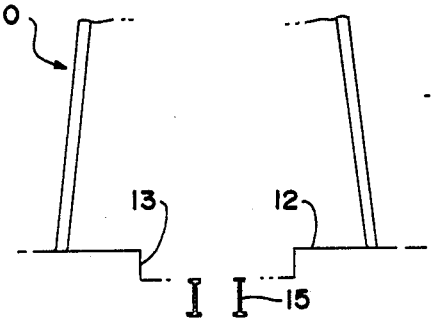
FIG. 2 represents the FIG. 1 well with the rotary table removed.
Figure 3:
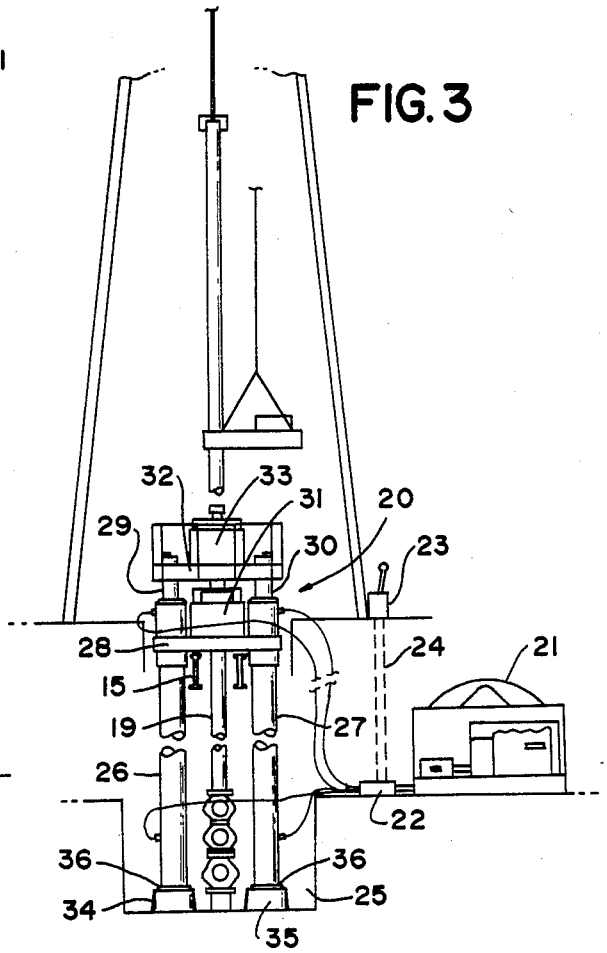
FIG. 3 shows the well of FIGS. 1 and 2 with a casing jacking mechanism embodying the present invention in position in the rig.

After the hole has been drilled to a desired depth, the rotary table is removed from opening 13 as represented in FIG. 2. In order to then lower into the well a string of casing pipe 19, a casing jacking mechanism 20 may be positioned in the rig as illustrated in FIG. 3, with a portion of this mechanism being contained within the opening or recess which initially held rotary table 14, and with the mechanism 20 projecting downwardly beyond that recess and beyond I beams 15 and projecting upwardly above the rig floor for engagement with the pipe at that location. The jacking mechanism is actuated by pressurized fluid, desirably being hydraulic, with the pressurized fluid being supplied by a power unit 21 which may be located on the surface of the earth beneath the rig floor, and which may include an engine and a pump driven thereby. A pilot operated control valve assembly 22 may also be located on the ground as seen in FIG. 3, and may be controlled by a pilot valve 23 accessible to an operator on the rig floor and controlling the valve assembly 22 through pilot lines 24. The usual cellar 25 may be formed in the earth beneath the rotary table location.

The jacking mechanism includes two support columns 26 and 27, a spider support beam 28 extending between the upper ends of the columns, two piston and cylinder mechanisms 29 and 30, a spider unit 31 supported by beam 28, an elevator support structure 32, and an elevator 33. The support columns 26 and 27 may be identical and formed as cylindrical hollow pipes or tubes supported at their lower ends on upper horizontal surfaces of foundations 34 and 35 formed of concrete or the like. Each of the support columns may have a horizontal plate 36 welded or otherwise secured to its lower end, and disposed transversely of the axis of the column to support the column in vertical condition when resting on the corresponding foundation 34 or 35. In the installed condition of FIG. 4, the two columns 26 and 27 have their axes 37 and 38 disposed vertically and parallel to one another and to the vertical axis 39 of the well bore 18. The two columns are desirably positioned at opposite sides of the two rotary table supporting beams 15. The upper ends of columns 26 and 27 are cut off in a horizontal or transverse plane 40, to support beam 28 in horizontal condition.

The support structure or beam 28 is a rigid unit formed of a number of metal parts welded or otherwise secured together, and including upper and lower horizontal parallel plates 41 and 42 containing aligned central openings 43 centered about vertical axis 39 to pass the casing 19 downwardly through structure 28. The two plates also contain a pair of vertically aligned circular openings 44 centered about axis 37, and to the right of axis 39 as viewed in FIG. 4 a second pair of aligned circular openings 45 centered about axis 38. The two axes 37 and 38 are at diametrically opposite locations with respect to the central vertical axis 39. At locations offset from and avoiding interference with the openings 43, 44 and 45, support structure 28 has vertically extending members rigidly welded or otherwise secured to both of the plates 41 and 42 and extending vertically therebetween to integrate the various parts of structure 28 into one unit. These connecting members may include two I beams 46 and 47 (FIG. 5) having their upper and lower flanges welded to plates 41 and 42 and having their webs extending vertically therebetween. Additional connecting plates or elements are represented at 48. The horizontal undersurface 49 of plate 42 engages downwardly against and is supported by the upper horizontal edge surfaces 50 of support columns 26 and 27 about openings 44 and 45, to effectively support structure 28 from the columns. For locating structure 28 relative to the support columns, the bottom plate 42 of structure 28 carries two downwardly projecting tubular guides or socket elements 150 and 151, centered about axes 37 and 38 and openings 44 and 45. The structure 28 may be connected to the rig substructure elements 52 and 53 by turnbuckles 54, connected at their opposite ends to the substructure elements and structure 28 respectively, and adjustable to shift structure 28 to a properly located relation with respect to axis 39 while at the same time maintaining the turnbuckle connections with the rig substructure elements tight and without play.

Each of the piston and cylinder mechanisms 29 and 30 includes a vertically extending hollow cylinder 55 of an external diameter receivable within the corresponding support column 26 or 27. A piston 56 is reciprocable within each of the cylinders, having a head 57 at its lower end and a somewhat reduced diameter shank 58 projecting upwardly through an opening 59 at the top of the cylinder to an upper extremity 60. The two piston rods 58 thus extend and are reciprocable relative to the cylinders along vertical axes 37 and 38. Pressurized hydraulic fluid is supplied to and exhausted from the lower end of the cylinders through lines 61, and is supplied to and discharged from the upper ends of the cylinders through lines 62. Each cylinder has an externally enlarged upper portion 63, typically of circular cross-section both internally and externally, and forming a downwardly facing horizontal annular shoulder 64 at the underside of this portion 63 annularly engageable with the upper horizontal surface of plate 41 about opening 44 or 45 to support the piston and cylinder mechanisms from structure 28 in the relationship illustrated in FIG. 4.

Figure 6:
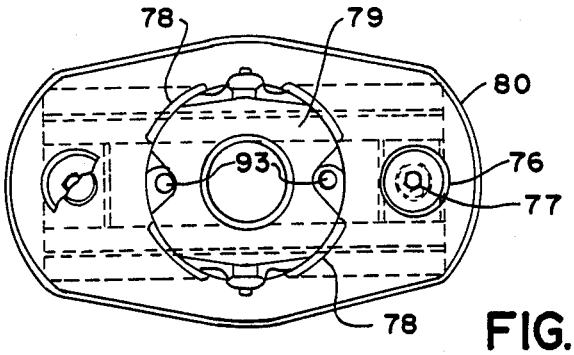
FIG. 6 is a top plan view taken on line 6—6 of FIG. 4.
Figure 7:
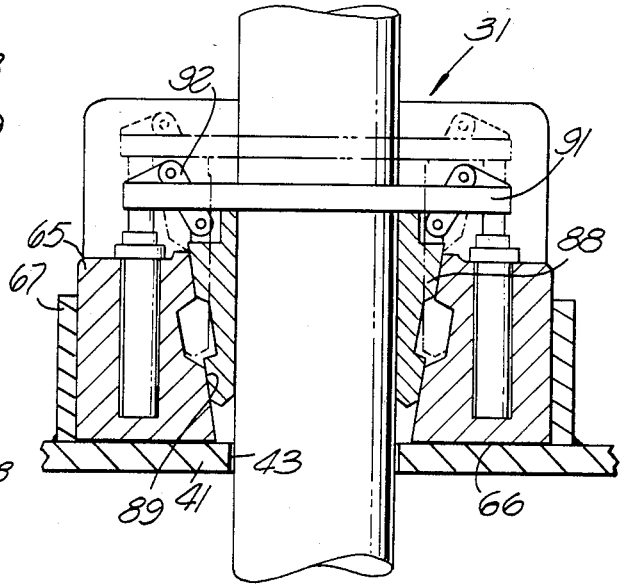
FIG. 7 is a vertical section through the spider unit 31.

On the upper surface of plate 41 of support structure 28, there is positioned between the two piston and cylinder mechanisms the spider or first casing support unit 31, which may be of a known construction including slips 88 (FIG. 7) power actuable to support or release a casing within a downwardly tapering central slip bowl opening 89 in a body 65 of unit 31, with that central opening being aligned with the opening 43 in structure 28. The undersurface 66 of the body 65 of unit 31 extends horizontally and rests on the upper surface of plate 41. Body 65 is centered with respect to axis 39 by reception within arcuately shaped locating elements 67 welded to plate 41 and projecting upwardly thereabove. As seen in FIG. 6, the arcuate elements 67 curve in correspondence with the outer surface of body 65 of unit 31 in centering relation. Slips 88 are power actuable upwardly and downwardly relative to body 65, between a lower active casing supporting position represented in full lines in FIG. 7 and an upper retracted position (broken lines in FIG. 7) in which the casing is free for downward movement relative to unit 31. Hydraulic piston and cylinder mechanisms 90 carried by body 65 act to shift the slips upwardly and downwardly, by actuation of a carrier element 91 from which the slips are movably suspended by links 92.

The structure 32 connected to the upper ends of piston rods 58 is in certain respects similar to the previously discussed structure 28, and in particular includes similarly shaped upper and lower horizontal parallel plates 68 and 69 secured rigidly together by I beams 70 and by other appropriate connector members, with plates 68 and 69 containing central openings 71 through which the casing extends and containing vertically aligned circular openings 72 and 73 through which upper reduced diameter portions 74 of the piston rods project, with annular upwardly facing horizontal shoulders 75 on the piston rods engaging upwardly against the horizontal undersurface of plate 69 about openings 72 and 73 to support structure 32 from the piston rods and connect the piston rods together by that structure. The upper ends of the piston rods may be detachably retained against removal from openings 72 and 73 by provision of retaining plates 76 at the upper ends of the piston rods secured thereto by screws or other fasteners 77 and engageable downwardly against the upper plate 68. Arcuate locating elements 78 may be welded to and project upwardly from the upper plate 68, and correspond to elements 67 of structure 28, and act to locate and center the elevator or upper support unit 33 resting on plate 68. This unit 33 may be constructed the same as the previously discussed unit 31, and include slips power actuable to releasably support the casing from unit 79. A railing 80 may project upwardly about the periphery of structure 32, to enclose an area within which a person may walk on the upper surface of plate 68. The body 65 of unit 31 and the corresponding body of unit 33 may each be formed as a single rigid annular element surrounding the casing and containing the slips, or alternatively and preferably may be formed of two halves detachably connected together by pins 93 (FIG. 6) at diametrically opposite locations, or connected together by a hinge pin and latch at such diametrically opposite locations, to facilitate placement of the unit 31 or 33 about a casing or removal laterally therefrom.

Figure 8:
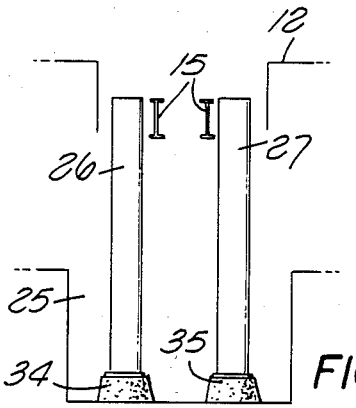
FIGS. 8, 9, 10, 11, 12 and 13 illustrate diagrammatically several different successive steps during assembly of the jacking mechanism of FIGS. 3 to 7.
Figure 9:
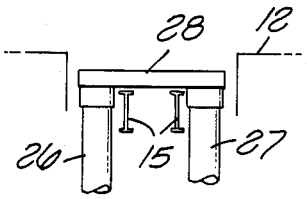
Figure 10:
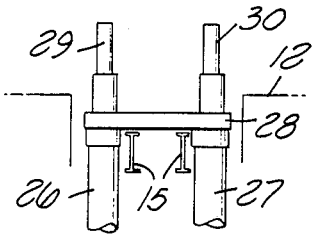

To now describe the manner in which the jacking mechanism of FIGS. 1 through 7 is assembled on the rig, assume that the rotary table has already been removed from its recess in the rig floor leaving the apparatus in the condition represented diagrammatically in FIG. 2. Assume also that the foundation members 36 have been provided at the bottom of the cellar 25. With the rig in this condition, the first step of assembly is to lower into the rotary table opening the two support columns 26 and 27, to the condition of FIG. 8 in which the lower ends of the columns are supported on the foundations. After such positioning of the support columns, the spider support structure or beam 28 is lowered into the rotary table recess to the position of FIG. 9, with the upper ends of the support columns entering guide tubes 50 and 51 and thereby being centered relative to openings 44 and 45 in structure 28. Engagement of the upper ends of the support columns with the underside of structure 28 then supports that structure from the columns. As the next step of assembly, the two piston and cylinder mechanisms 29 and 30 are lowered downwardly through their respective openings in structure 28 and into two support columns 26 and 27 respectively, and to the positions of FIG. 4 in which engagement of the upper enlarged portions of the cylinders with top plate 41 supports the piston and cylinder mechanisms from structure 28. This assembly step is represented in FIG. 10.

Figure 11:
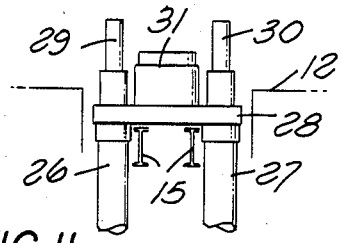
Figure 12:
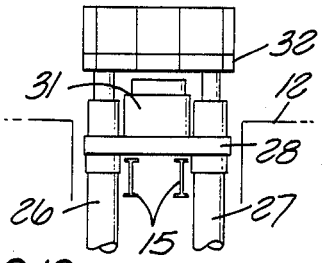
Figure 13:
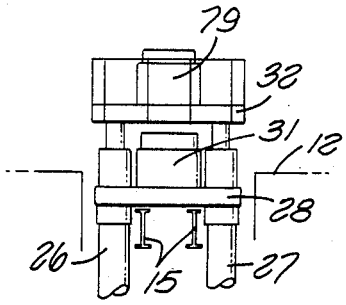

The lower pipe supporting unit 31 is next lowered downwardly onto the upper surface of top plate 41 of structure 28, as represented in FIG. 11, and is centered by elements 67. After such placement of unit 31, the upper support structure 32 is moved downwardly relative to the piston and cylinder mechanisms, as represented in FIG. 12, with the upper ends of the piston rods extending into openings 72 and 73, to support structure 32 in located relation, and with elements 76 then being attached to the piston rods to retain these parts in assembled relation. Finally, the upper pipe contacting unit 33 is placed on and supported by the upper surface of plate 68 of structure 32, as seen in FIG. 13, being centered by elements 78.

Figure 4:
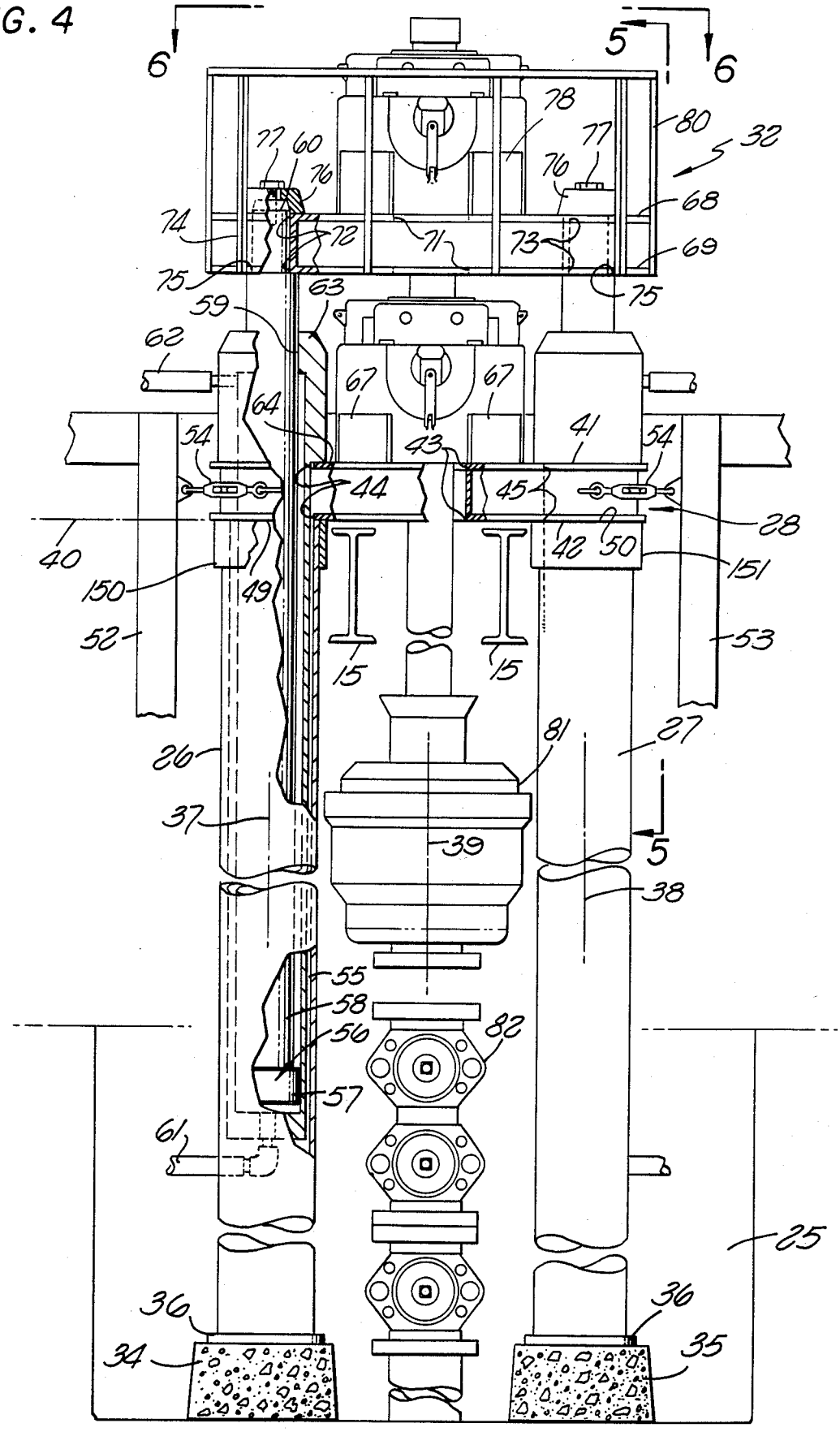
FIG. 4 is an enlarged elevational view, partially broken away in vertical section, of the FIG. 3 apparatus.

After the jacking apparatus has been assembled in this manner to the condition represented in FIGS. 3 and 4, that mechanism can then be utilized to lower the casing 19 progressively into the well bore. During such lowering, there is normally connected to the upper end of the well one or more blowout preventors 81 or 82, located beneath the rig floor level and beneath the rotary table support beams 15. The two piston and cylinder mechanisms and surrounding support columns 26 and 27 are desirably received at diametrically opposite sides of these blowout preventors as illustrated in FIG. 4. The casing is lowered by supplying pressure fluid to the upper ends of the cylinders and discharging it from the lower ends of the cylinders to cause controlled downward movement of pistons 56 and the connected structure 32 and unit 33. During such downward movement, the slips of unit 33 are in gripping and supporting engagement with the casing, while the slips of unit 31 are released and do not support the casing, so that the downward movement of structure 32 causes corresponding downward movement of the engaged section of casing. When the pistons and structure 32 reach the lower limits of their travel, as for instance in the position of FIG. 4, the slips of spider unit 31 are actuated to grip and support the casing, while the slips of the elevator unit 33 are released, following which pressure fluid is supplied to the lower ends of the cylinders and discharged from their upper ends to cause upward movement of the pistons and the structure 32 and unit 33 to the upper ends of their range of travel. When that upper position is reached, the slips of unit 33 are actuated to again grip the casing, while the slips of unit 31 are actuated to released condition, and another downward stroke of the pistons and structure 32 and unit 33 is induced to lower the casing through another step. This process is repeated until the desired length of casing has been lowered into the well. Added joints of casing can be connected to the upper end of the string as necessary by a conventional single joint elevator suspended from a traveling block in the customary manner.

Figure 14:
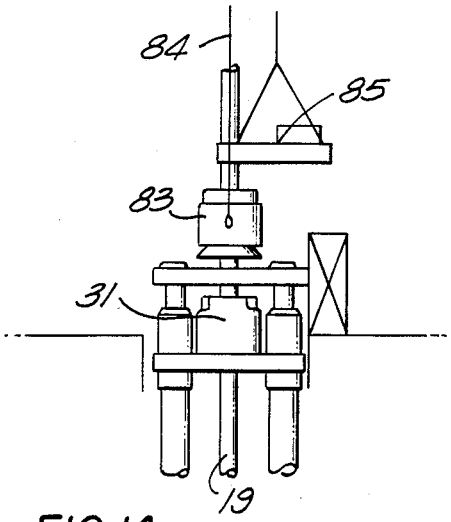
FIG. 14 illustrates the manner in which a portion of the apparatus may be utilized during the first stages of a casing lowering operation.

The two units 31 and 33 may be of very heavy construction, and be capable of supporting very heavy lengths of casing, say for example up to a 1,000 ton load. This load may be substantially greater than that which the mast of the rig would be capable of handling without provision of the jacking mechanism. As an example, the load capacity of the mast might be limited to 500 tons. In that event, during the initial portion of the casing lowering operation, and until the weight of the installed casing reached the 500 ton limit, the first part of the casing might be lowered without powered actuation of the jacking mechanism, and utilizing unit 31 as a spider in conjunction with a line supported 500 ton capacity elevator 83 as represented in FIG. 14. This elevator 83 can be supported by a line 84 leading from the traveling block, and may suspend the casing 19 and lower it through spider 31 with the slips of that spider released. When the elevator 83 reaches its lowermost position, the slips of spider 31 can be actuated to grip and support the installed length of casing, while another length of casing is connected to the upper end of the string by means including a tong device 85, following which elevator 83 may be moved upwardly along the added length of casing and toward its upper end, with the slips of unit 83 released, and with those slips then being actuated to gripping condition to hold the upper end of the casing and suspend it while the slips of unit 31 are released to enable the casing to be lowered further in the well. This process can be repeated, with the upper unit 33 removed from the jacking mechanism, until a suspended casing load near the capacity of elevator 83 is reached, at which time the elevator 83 can be detached, and the heavier unit 33 can be placed in position on structure 32, to permit continuation of the lowering process by the jacking mechanism.

After the casing has been completely installed in the well, the entire jacking mechanism can be removed from the rig by a process which is the reverse of the discussed installation process. More particularly, unit 33 can first be withdrawn upwardly from structure 32, following which elements 76 can be detached and structure 32 can be removed upwardly from the upper ends of the piston rods, after which unit 31 can be moved upwardly from its position of support on structure 28. Next, the piston and cylinder units 29 and 30 can be pulled upwardly from their positions of reception within columns 26 and 27 and structure 28, and the structure 28 can then be withdrawn upwardly from its position of support on the columns. Finally, columns 26 and 27 can be withdrawn upwardly to leave the rig in its FIG. 2 condition.

Figure 17:
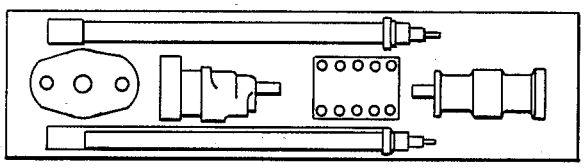
FIG. 17 is a plan view of the components of the jacking mechanism loaded for transport to or from a well site.
Figure 18:
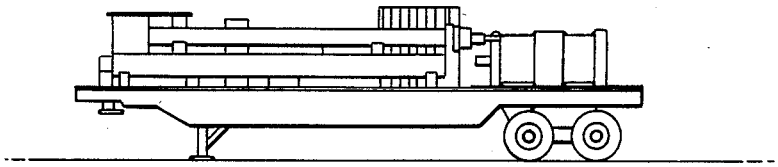
FIG. 18 is a side elevational view taken on line 18—18 of FIG. 17.

Because of the unique manner of assembling and disassembling the jacking mechanism on the rig, this mechanism though very heavy in the aggregate can be assembled without the use of excessively high capacity lifting equipment. Each of the components of the mechanism is light enough that it can be lowered into position by simple light-weight hoisting equipment, and the entire group of components can be transported to and from a rig site on a conventional flatbed truck. FIGS. 17 and 18 illustrate diagrammatically the manner in which the components can be arranged and supported on such a truck.

Figure 15:
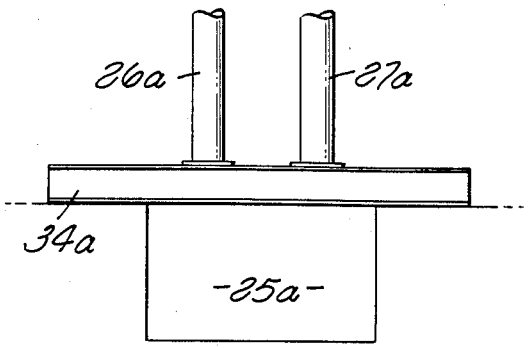
FIG. 15 is a view corresponding to a portion of FIG. 3, but showing a variational form of the invention.

FIG. 15 represents a variational arrangement, which may be considered the same as that of FIGS. 1 to 13 except that the support columns 26*a* and 27*a* do not project downwardly into cellar 25*a*, but rather are supported on a beam or beams 34*a* bridging across the top of the cellar and supported on the ground surface at opposite sides of the cellar.

Figure 5:
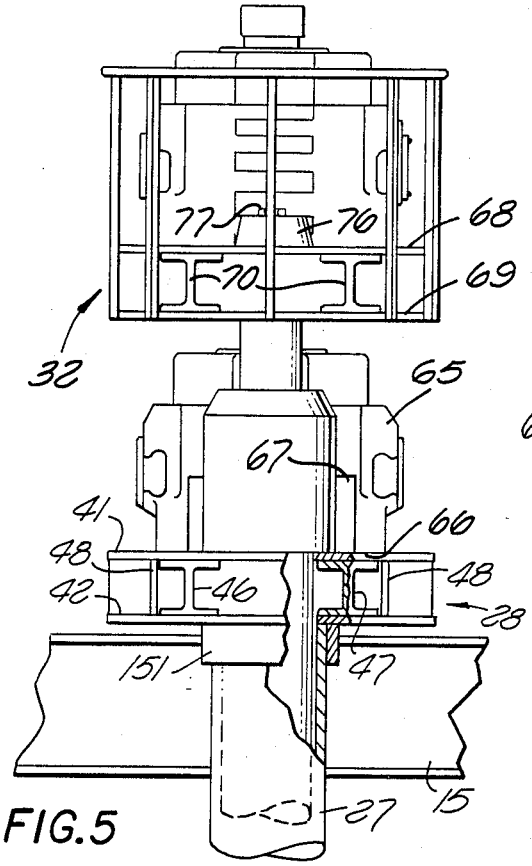
FIG. 5 is a side view taken on line 5—5 of FIG. 4.
Figure 16:
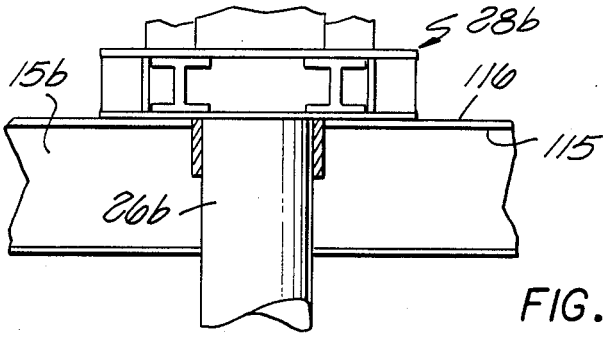
FIG. 16 is a view corresponding to a portion of FIG. 5, but showing another variational arrangement.

FIG. 16 is a view similar to a portion of FIG. 5, showing another variational arrangement which may be considered as identical with that of the first form of the invention except that the structure 28*b*, corresponding to structure 28 of FIGS. 4 and 5, is supported directly by the beams 15*b* (corresponding to beams 15 of FIG. 1) which normally support the rotary table. These beams bridge across the underside of the rotary table receiving recess or opening, and are secured at opposite sides of that opening to the rig substructure, and have upper flanges 115 with top surfaces 116 engaging the underside of structure 28*b* to effectively support it. As in FIG. 3, two such beams may be received at opposite sides of the well bore axis, and act to support structure 28*b* at both of those locations. The support columns 26*b* may then be omitted if desired, or may be appropriately connected to structure 28 and project downwardly therefrom about the piston and cylinder mechanisms to provide housings thereabout, but with no necessity for the lower ends of the columns to contact a supporting foundation or the like.

While certain specific embodiments of the present invention have been disclosed as typical, the invention is of course not limited to these particular forms, but rather is applicable broadly to all such variations as fall within the scope of the appended claims.

We claim:

1. The method that comprises:

drilling a well utilizing a rig which includes a mast projecting upwardly above the well in a predetermined drilling position, and utilizing a drill string extending along a predetermined axis relative to said mast and downwardly into the well;

removing said drill string from the rig after completion of the drilling operation;

then lowering along said axis and into the well, while said mast remains in said drilling position above the well, a string of casing which, during at least a portion of the casing lowering operation, has a weight greater than the load supporting capacity of said mast used in drilling;

effecting the downward movement of said casing string, during at least said portion of the casing lowering operation when the weight of the string exceeds the capacity of the mast, by relatively vertically actuating two casing supporting units of a jacking mechanism positioned in the rig, with the casing string being supported alternately by the two units respectively; and transmitting downward load forces resulting from the weight of said casing string from each of said supporting units to the earth without transmission of said forces through said mast, but while said mast used in drilling remains in said drilling position above the well.

2. The method as recited in claim 1, including installing at least a portion of said jacking mechanism in the rig after completion of said drilling operation.

3. The method as recited in claim 1, in which said rig has a floor containing an opening through which said drill string extends, said jacking mechanism including fluid pressure operated means for power actuating one of said units upwardly and downwardly relative to the other to lower the casing string into the well, said method including locating said jacking mechanism in the rig with said fluid pressure operated means projecting downwardly beneath the level of said rig floor and with said units accessible from above the level of said floor.

4. The method as recited in claim 1, in which said rig has a rotary table for turning said drill string, said method including removing said rotary table from the rig after completion of the drilling operation, and then installing at least a portion of said jacking mechanism in the rig at approximately the location at which the rotary table had been during drilling.

5. The method as recited in claim 1, in which said jacking mechanism includes a plurality of piston and cylinder mechanisms for relatively vertically actuating said units, and two support structures extending between said piston and cylinder mechanisms for supporting said two units respectively, said method including lowering said piston and cylinder mechanisms through openings in one of said support structures and to positions of extension downwardly therebeneath after removal of said drill string from the rig.

6. The method as recited in claim 1, in which, during an initial portion of the casing lowering operation while the weight of the casing string is within the capacity of the mast, the casing string is lowered by upward and downward movement of a suspending device carried by a travelling block of the rig, with the casing string being supported alternately by said device and by one of said units of the jacking mechanism.

7. The method as recited in claim 1, in which said jacking mechanism includes two piston and cylinder mechanisms for relatively vertically actuating said units, said method including positioning two tubular columns at different sides of said axis in essentially parallel generally vertically extending condition, and then lowering said piston and cylinder mechanisms into said columns to positions in which the cylinder of each mechanism is supported by the column within which that mechanism is received and the piston projects upwardly beyond said column to actuate one of said units upwardly and downwardly relative to the other.

8. The method as recited in claim 7, including connecting a structure to upper ends of said columns in a position of extension therebetween for supporting said other unit, and suspending said cylinders from said structure for support by the columns through said structure.

9. The method that comprises:

drilling a well bore utilizing a drill string driven rotatively about an axis by a rotary table mounted at a predetermined active position in a rig;

removing said rotary table from said active position in the rig after the well bore has been drilled;

positioning in said rig used in drilling, after removal of the rotary table therefrom, upper and lower casing supporting assemblies each carrying slip means adapted to releasably support a casing string, with said lower assembly being located at approximately said active position of the rotary table in said rig and said upper assembly being located above said active position of the rotary table;

at some point during said method positioning in said rig at different sides of said axis a plurality of fluid operated piston and cylinder units which project downwardly to a level substantially lower than said active position of the rotary table and are connected operatively to said upper support assembly to actuate it upwardly and downwardly relative to said lower assembly; and lowering a casing string heavier than said drill string into the well bore by upward and downward actuation of said upper assembly by said piston and cylinder units relative to said lower assembly while gripping the casing string alternately by said two assemblies.

10. The method as recited in claim 9, in which said rig includes a rig floor containing an opening within which said rotary table is received in said active position thereof, and includes a beam structure on which the rotary table is supported in said predetermined active position thereof, said step of positioning the upper and lower casing supporting assemblies including locating said lower assembly within said opening and above and closely adjacent said beam structure, and said step of positioning said fluid operated units including locating them in positions of extension downwardly beneath said floor and said beam structure.

11. The method that comprises:

drilling a well bore utilizing a drill string driven rotatively about an axis by a rotary table mounted at a predetermined active position in a rig;

removing said rotary table from said active position in the rig after the well bore has been drilled;

positioning in said rig used in drilling, after removal of the rotary table therefrom, upper and lower casing supporting assemblies each carrying slip means adapted to releasably support a casing string, with said lower assembly being located at approximately said active position of the rotary table in said rig and said upper assembly being located above said active position of the rotary table;

at some point during said method positioning in said rig at different sides of said axis a plurality of fluid operated piston and cylinder units which project downwardly to a level substantially lower than said active position of the rotary table and are connected operatively to said upper casing supporting assembly to actuate it upwardly and downwardly relative to said lower assembly; and lowering a casing string heavier than said drill string into the well bore by upward and downward actuation of said upper assembly by said piston and cylinder units relative to said lower assembly while gripping the casing string alternately by said two assemblies;

said rig including a rig floor containing an opening within which said rotary table is received in said active position thereof, and including a beam structure on which the rotary table is supported in said predetermined active position thereof;

said step of positioning the upper and lower casing supporting assemblies including locating said lower assembly within said opening and above and closely adjacent said beam structure; and said step of positioning said fluid operated units including locating them in positions of extension downwardly beneath said floor and said beam structure.

* * * * *